US005464688A

United States Patent [19]

Timmons et al.

[11] Patent Number: 5,464,688

[45] Date of Patent: Nov. 7, 1995

[54] NONWOVEN WEB LAMINATES WITH IMPROVED BARRIER PROPERTIES

[75] Inventors: Terry K. Timmons; Peter Kobylivker; Lin-Sun Woon, all of Marietta; Laura E. Keck; Jerald T. Jascomb, both of Alpharetta, all of Ga.

[73] Assignee: Kimberly-Clark Corporation, Neenah, Wis.

[21] Appl. No.: 296,822

[22] Filed: Aug. 26, 1994

Related U.S. Application Data

[63] Continuation-in-part of Ser. No. 47,219, Apr. 14, 1993, abandoned, and a continuation-in-part of Ser. No. 976,774, Nov. 16, 1992, Pat. No. 5,271,883, is a continuation of Ser. No. 799,929, Nov. 26, 1991, Pat. No. 5,213,881, and a continuation of Ser. No. 540,070, Jun. 18, 1990, abandoned.

[51] Int. Cl.[6] ..... B32B 5/06

[52] U.S. Cl. ..... 428/298; 428/224; 428/284; 428/286; 428/288; 428/296; 428/297; 428/903; 428/304.4

[58] Field of Search ..... 428/224, 288, 428/903, 284, 286, 296, 297, 298, 304.4

[56] References Cited

U.S. PATENT DOCUMENTS

| | | | |
|---|---|---|---|
| 3,338,992 | 8/1967 | Kinney | 264/24 |
| 3,502,538 | 6/1968 | Petersen | 161/150 |
| 3,502,763 | 3/1970 | Hartmann | 264/210 |
| 3,542,615 | 11/1970 | Dobo et al. | 156/181 |
| 3,562,804 | 2/1971 | Powers | 260/85.3 |
| 3,692,618 | 9/1972 | Dorschner et al. | 161/72 |
| 3,841,953 | 10/1974 | Lohkamp et al. | 161/150 |
| 3,849,241 | 11/1974 | Butin et al. | 161/169 |
| 3,862,265 | 1/1975 | Steinkamp et al. | 260/878 R |
| 3,909,009 | 9/1975 | Cvetko et al. | 274/37 |
| 3,953,655 | 4/1976 | Steinkamp et al. | 428/474 |
| 3,981,957 | 9/1976 | Van Brederode et al. | 260/878 R |
| 4,001,172 | 1/1977 | Steinkamp et al. | 260/42.18 |
| 4,041,203 | 8/1977 | Brock et al. | 428/157 |
| 4,301,029 | 11/1981 | Caunt et al. | 252/429 B |
| 4,307,143 | 12/1981 | Meitner | 252/91 |
| 4,329,252 | 5/1982 | Gavens et al. | 252/429 B |
| 4,340,563 | 7/1982 | Appel et al. | 264/518 |
| 4,374,888 | 2/1983 | Bornslaeger | 428/198 |
| 4,410,649 | 10/1983 | Cieloszyk | 524/108 |
| 4,412,025 | 10/1983 | Corwin et al. | 524/241 |
| 4,424,138 | 1/1984 | Candlin et al. | 502/162 |

(List continued on next page.)

FOREIGN PATENT DOCUMENTS

| | | |
|---|---|---|
| 803714 | 1/1969 | Canada . |
| 0316195 | 5/1989 | European Pat. Off. . |
| 0370835 | 5/1990 | European Pat. Off. . |
| 1902573 | 9/1970 | Germany . |

OTHER PUBLICATIONS

"Manufacture of Superfine Organic Fibers"—Wente et al., NRL Report 4362—111437—May 25, 1954.

"An Improved Device For The Formation of Superfine, Thermoplastic Fibers"—Lawrence et al., NRL Report 5265—Feb. 11, 1959.

*Primary Examiner*—James J. Bell

*Attorney, Agent, or Firm*—William D. Herrick

[57] ABSTRACT

There is disclosed a nonwoven web for use as a barrier layer in an SMS fabric laminate. The web is formed at commercially acceptable polymer melt throughputs (greater than 3 PIH) by using a reactor granule polyolefin, preferably polypropylene, that has been modified by the addition of peroxide in amounts ranging from up to 3000 ppm to reduce the molecular weight distribution from an initial molecular weight distribution of from 4.0 to 4.5 Mw/Mn to a range of from 2.2 to 3.5 Mw/Mn. Also the addition of peroxide increases the melt flow rate (lowers viscosity) to a range between 800 up to 5000 gms/10 min at 230° C. The resulting web has an average fiber size of from 1 to 3 microns and pore sizes distributed predominantly in the range from 7 to 12 microns, with a lesser amount of pores from 12 to 25 microns, with virtually no pores greater than 25 microns, and with the peak of the pore size distribution less than 10 microns.

26 Claims, 2 Drawing Sheets

U.S. PATENT DOCUMENTS

| | | | |
|---|---|---|---|
| 4,443,513 | 4/1984 | Meitner et al. | 422/195 |
| 4,451,589 | 5/1984 | Morman et al. | 523/124 |
| 4,508,859 | 4/1985 | Muhle et al. | 523/346 |
| 4,760,113 | 7/1988 | Chiba et al. | 525/53 |
| 4,780,438 | 10/1988 | Garoff et al. | 502/107 |
| 4,804,577 | 2/1989 | Hazelton et al. | 428/224 |
| 4,818,799 | 4/1989 | Chatterjee et al. | 526/123 |
| 4,824,885 | 4/1989 | Magni et al. | 524/120 |
| 4,863,785 | 9/1989 | Berman et al. | 428/218 |
| 4,892,852 | 1/1990 | Sampson et al. | 502/107 |
| 4,895,897 | 1/1990 | Kaufman | 525/67 |
| 4,921,920 | 5/1990 | Collomb-Ceccarini et al. | 526/125 |
| 4,958,006 | 9/1990 | Bernier et al. | 528/501 |
| 4,988,781 | 1/1991 | McKinney et al. | 526/68 |

NONWOVEN WEB LAMINATES WITH IMPROVED BARRIER PROPERTIES

This application is a continuation-in-part of copending U.S. patent application Ser. No. 08/047,219 filed Apr. 14, 1993 now abandoned, a continuation-in-part of U.S. Pat. application Ser. No. 07/976,774 filed Nov. 16, 1992 issued as U.S. Pat. No. 5,271,883, a division of U.S. patent application Ser. No. 07/799,929 filed Nov. 26, 1991 issued as U.S. Pat. No. 5,213,881 and a continuation of U.S. patent application Ser. No. 07/540,070 filed Jun. 18, 1990, abandoned.

BACKGROUND OF THE INVENTION

This invention relates generally to a nonwoven web having fine fibers and a small pore size distribution and a method for forming such a web. The method of the present invention uses a reactor granule resin having an initial broad molecular weight distribution which resin has been modified to narrow its molecular weight distribution and to increase its melt flow rate. Consequently the nonwoven web can be formed by melt-blowing at high throughputs. Such nonwoven webs are particularly useful as barrier layers for fabric laminates.

Nonwoven fabric laminates are useful for a wide variety of applications. Such nonwoven fabric laminates are useful for wipers, towels, industrial garments, medical garments, medical drapes, and the like. In heavier basis weights the laminates are used in recreational applications such as tents and as car covers. Disposable fabric laminates have achieved especially widespread use in hospital operating rooms for drapes, gowns, towels, footcovers, sterilization wraps, and the like. Such surgical fabric laminates are generally spunbonded/meltblown/spunbonded (SMS) laminates consisting of nonwoven outer layers of spunbonded polyolefins and an interior barrier layer of meltblown polyolefins. Particularly, Kimberly-Clark Corporation, the assignee of the present invention, has for a number of years manufactured and sold SMS nonwoven surgical fabric laminates, sterilization wrap and recreational fabrics under the marks Spunguard® and Evolution®. Such SMS fabric laminates have outside spunbonded layers which are durable and an internal meltblown barrier layer which is porous but which, in combination with the spunbond layers, inhibits the strikethrough of fluids or the penetration of bacteria from the outside of the fabric laminate to the inside. In order for such a medical fabric to perform properly, it is necessary that the meltblown barrier layer have a fiber size and a pore size distribution that assures breathability of the fabric while at the same time inhibiting strikethrough of fluids and bacteria.

The current meltblown web used in the manufacture of the Kimberly-Clark Evolution® medical fabric laminate has pore sizes distributed predominantly in the range from 10 to 15 microns with the peak of the pore size distribution greater than 10 microns. While such a meltblown web has advantages as a barrier layer, significant improvement in porosity and inhibition of strikethrough can be achieved with a meltblown web having average fiber sizes of from 1 to 3 microns and having a distribution of pore sizes so that the majority of pores are in the range of 7 to 12 microns with the peak of the pore size distribution less than 10 microns. More particularly, improved performance characteristics with respect to porosity and strikethrough can be achieved when the meltblown web has pore sizes distributed predominantly in the range from 7 to 12 microns, with a lesser amount of pores from 12 to 25 microns, and with virtually no pores greater than 25 microns as measured by the Coulter Porometer.

It is therefore an object of the present invention to provide a nonwoven web for use as a barrier layer in a fabric laminate which nonwoven web has an average fiber diameter of from 1 to 3 microns and pore sizes distributed predominantly in the range from 7 to 12 microns, with a lesser amount of pores from 12 to 25 microns, with virtually no pores greater than 25 microns, and with the peak of the pore size distribution less than 10 microns.

It is likewise an object of the present invention to provide a nonwoven fabric laminate having a barrier layer of fine fibers and small pore size distribution such that the resulting fabric laminate has pore sizes distributed predominantly in the range from 5 to 10 microns, with a lesser amount of pores from 10 to 15 microns, with virtually no pores greater than 22 microns, and with the pore size distribution shifted downward from the pore size distribution of laminate structures made using conventional meltblown webs.

The foregoing objectives are preferably obtained by forming a meltblown web from a propylene polymer resin having a broad molecular weight distribution and having a high melt flow rate which resin is modified by the addition of a small amount of peroxide prior to processing to achieve an even higher melt flow rate (lower viscosity). In general, the present invention involves starting with a propylene polymer in the form of reactor granules which polymer has a molecular weight distribution of 3.6 to 4.8 Mw/Mn, preferably 3.6 to 4.0 Mw/Mn and an initial melt flow rate of about 400 gms/10 min to 3000 gms/10 min at 230° C. Such a molecular weight reactor granule polymer is then modified to reduce and narrow the polymer's molecular weight distribution to a range from 2.2 to 3.5 Mw/Mn by the addition of up to 3000 parts per million (ppm) of peroxide. During the meltblowing process, the modified reactor granule polymer has an increased melt flow rate from 400 gms/10 min. to 3000, for example, to a range between 800 up to 5000 gms/10 min at 230° C.

Particularly preferred embodiments include a polypropylene resin in the form of a reactor granule having a starting molecular weight distribution of 3.6 to 4.8 Mw/Mn and an initial melt flow rate of from 600 to 3000 gms/10 min. at 230° C. which is combined with a small amount of peroxide, less than 500 ppm, to produce a modified polypropylene having a very high melt flow rate of up to 5000 gms/10 min. at 230° C. and a narrower molecular weight distribution of 2.8 to 3.5 Mw/Mn.

Alternatively, an improved meltblown web for use as a barrier layer can be formed by utilizing a resin, particularly polypropylene, having a narrow molecular weight distribution and having a lower melt flow rate which resin is modified by the addition of a larger amount of peroxide prior to meltblowing to achieve a high melt flow rate. The starting reactor granule polypropylene resin in this case has a molecular weight distribution between 4.0 and 4.8 Mw/Mn and a melt flow rate ranging from 400 to 1000 gms/10 min. at 230° C. The polypropylene resin is modified by adding peroxide in amounts ranging from 500 to 3000 ppm (the higher amounts of peroxide being used in connection with the lower initial melt flow rate). The modified polypropylene resin has a melt flow rate, up to about 3000 gms/10 min. at 230° C. and a narrow molecular weight distribution of 2.2 to 2.8 Mw/Mn, for example.

Most preferably, the starting polypropylene resin for the meltblown web of the present invention is a polypropylene reactor granule which resin has a molecular weight distribution between 3.6 and 4.8 Mw/Mn, has a melt flow rate of up to 3000 gms/10 min. at 230° C., and is treated with about 500 ppm of peroxide to produce a modified resin having a melt flow rate greater than 2000 gms/10 min. at 230° C. and a molecular weight distribution of from 2.8 to 3.5 Mw/Mn. The broader molecular weight distribution at the high melt flow rate helps minimize production of lint and polymer droplets (shot).

Other objects and advantages of the invention will become apparent upon reading the following detailed description and upon reference to the drawings.

DETAILED DESCRIPTION OF THE INVENTION

While the invention will be described in connection with preferred embodiments, it will be understood that we do not intend to limit the invention to those embodiments. On the contrary, we intend to cover all alternatives, modifications, and equivalents as may be included within the spirit and scope of the invention as defined by the appended claims.

Figure 1:
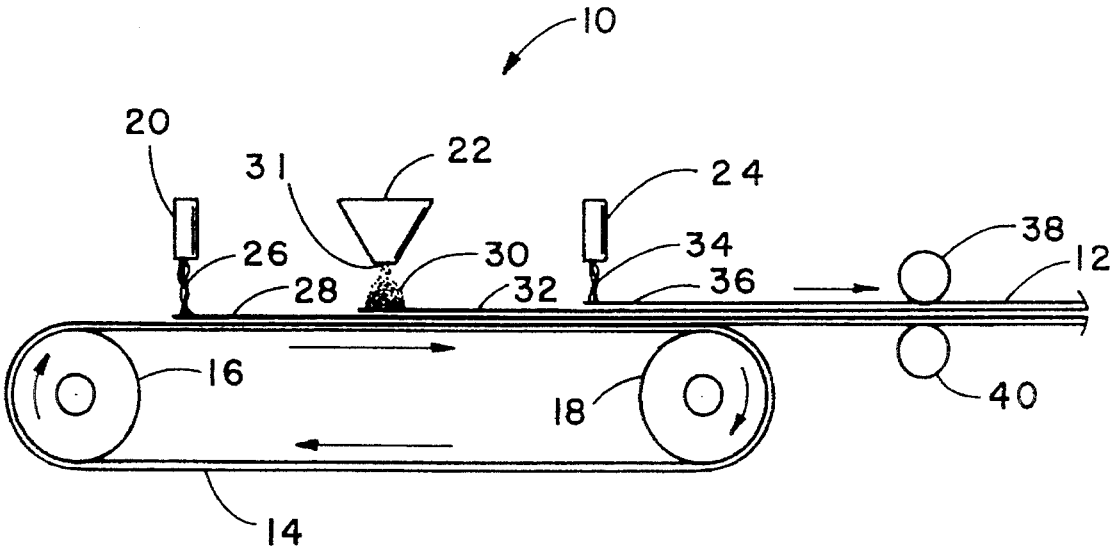
FIG. 1 is a schematic diagram of a forming machine which is used in making the nonwoven fabric laminate including the melt-blown barrier layer of the present invention.

Turning to FIG. 1, there is shown schematically a forming machine 10 which may be used to produce an SMS fabric laminate 12 having a meltblown barrier layer 32 in accordance with the present invention. Particularly, the forming machine 10 consists of an endless foraminous forming belt 14 wrapped around rollers 16 and 18 so that the belt 14 is driven in the direction shown by the arrows. The forming machine 10 has three stations, spunbond station 20, meltblown station 22, and spunbond station 24. It should be understood that more than three forming stations may be utilized to build up layers of higher basis weight. Alternatively, each of the laminate layers may be formed separately, rolled, and later converted to the SMS fabric laminate off-line. In addition the fabric laminate 12 could be formed of more than or less than three layers depending on the requirements for the particular end use for the fabric laminate 12. For example, for recreational fabric and car cover applications it is preferred to have at least two inner meltblown layers for improved performance.

The spunbond stations 20 and 24 are conventional extruders with spinnerets which form continuous filaments of a polymer and deposit those filaments onto the forming belt 14 in a random interlaced fashion. The spunbond stations 20 and 24 may include one or more spinneret heads depending on the speed of the process and the particular polymer being used. Forming spunbonded material is conventional in the art, and the design of such a spunbonded forming station is thought to be well within the ability of those of ordinary skill in the art. The nonwoven spunbonded webs 28 and 36 are prepared in conventional fashion such as illustrated by the following patents: Dorschner et al. U.S. Pat. No. 3,692,618; Kinney U.S. Pat. Nos. 3,338,992 and 3,341,394; Levy U.S. Pat. No. 3,502,538; Hartmann U.S. Pat. Nos. 3,502,763 and 3,909,009; Dobo et al. U.S. Pat. No. 3,542,615; Harmon Canadian Patent No. 803,714; and Appel et al. U.S. Pat. No. 4,340,563. Other methods for forming a nonwoven web having continuous filaments of a polymer are contemplated for use with the present invention.

Spunbonded materials prepared with continuous filaments generally have at least three common features. First, the polymer is continuously extruded through a spinneret to form discrete filaments. Thereafter, the filaments are drawn either mechanically or pneumatically without breaking in order to molecularly orient the polymer filaments and achieve tenacity. Lastly, the continuous filaments are deposited in a substantially random manner onto a carrier belt to form a web. Particularly, the spunbond station 20 produces spunbond filaments 26 from a fiber forming polymer. The filaments are randomly laid on the belt 14 to form a spunbonded external layer 28. The fiber forming polymer is described in greater detail below.

The meltblown station 22 consists of a die 31 which is used to form microfibers 30. The throughput of the die 31 is specified in pounds of polymer melt per inch of die width per hour (PIH). As the thermoplastic polymer exits the die 31, high pressure fluid, usually air, attenuates and spreads the polymer stream to form microfibers 30. The microfibers 30 are randomly deposited on top of the spunbond layer 28 and form a meltblown layer 32. The construction and operation of the meltblown station 22 for forming microfibers 30 and meltblown layer 32 are considered conventional, and the design and operation are well within the ability of those of ordinary skill in the art. Such skill is demonstrated by NRL Report 4364, "Manufacture of Super-Fine Organic Fibers" by V. A. Wendt, E. L. Boon, and C. D. Fluharty; NRL Report 5265, "An Improved Device for the Formation of Super-Fine Thermoplastic Fibers", by K. D. Lawrence, R. T. Lukas, and J. A. Young; and U.S. Pat. No. 3,849,241, issued Nov. 19, 1974, to Buntin et al. Other methods for forming a nonwoven web of microfibers are contemplated for use with the present invention.

The meltblown station 22 produces fine fibers 30 from a fiber forming polymer which will be described in greater detail below. The fibers 30 are randomly deposited on top of spunbond layer 28 to form a meltblown internal layer 32. For an SMS medical fabric laminate, for example, the meltblown barrier layer 32 has a basis weight of preferably about 0.35–0.50 oz./yd.$^2$.

After the internal layer 32 has been deposited by the meltblown station 22 onto layer 28, spunbond station 24 produces spunbond filaments 34 which are deposited in random orientation on top of the meltblown layer 32 to produce external spunbond layer 36. For an SMS medical fabric laminate, for example, the layers 28 and 36 each have a basis weight of preferably from about 0.30 oz./yd.$^2$ to about 1.2 oz./yd.$^2$.

Figure 2:
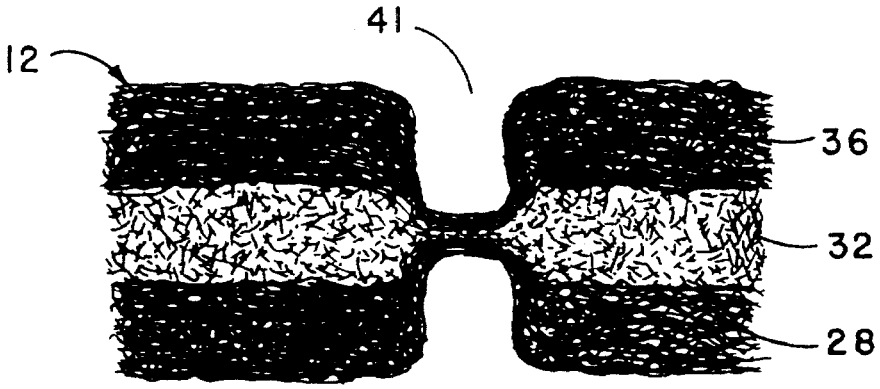
FIG. 2 is a cross-section view of the nonwoven fabric laminate of the present invention showing the layer configuration including the internal meltblown barrier layer made in accordance with the present invention.

The resulting SMS fabric laminate web 12 (FIG. 2) is then fed through bonding rolls 38 and 40. The surfaces of the bonding rolls 38 and 40 are provided with a raised pattern such as spots or grids. The bonding rolls are heated to the softening temperature of the polymer used to form the layers of the web 12. As the web 12 passes between the heated bonding rolls 38 and 40, the material is compressed and heated by the bonding rolls in accordance with the pattern on the rolls to create a pattern of discrete areas, such as 41 shown in FIG. 2, which areas are bonded from layer to layer and are bonded with respect to the particular filaments and/or fibers within each layer. Such discrete area or spot bonding is well-known in the art and can be carried out as described by means of heated rolls or by means of ultrasonic heating of the web 12 to produced discrete area thermally bonded filaments, fibers, and layers. In accordance with conventional practice described in Brock et al., U.S. Pat. No. 4,041,203, it is preferable for the fibers of the meltblown layer in the fabric laminate to fuse within the bond areas while the filaments of the spunbonded layers retain their integrity in order to achieve good strength characteristics. For heavier basis weight laminates for recreational fabrics and car covers, sonic bonding as described in U.S. Pat. No. 4,374,888, incorporated herein by reference, is preferred.

In accordance with the present invention, we have found that the throughput (PIH) of the die head 22 may be increased while at the same time providing fine fibers by using a reactor granule form of the polymer rather than a pelletized form, which polymer in reactor granular form has a molecular weight distribution of 3.6 to 4.8 Mw/Mn and a melt flow rate of about 400 gms/10 min to 3000 gms/10 min at 230° C. Such a molecular weight reactor granule polymer is then modified to reduce the polymer's molecular weight distribution to a range from 2.2 to 3.5 Mw/Mn by the addition of up to 3000 ppm of peroxide. During the meltblowing process, the modified reactor granule polymer has an increased melt flow rate from 400 gms/10 min. to 3000 gms/10 min, for example, to a range from 800 up to 5000 gms/10 min at 230° C. By modifying the starting polymer, the resulting polymer will have a lower extensional viscosity, thus taking less force to attenuate the fibers as they exit the die 31. Therefore, with the same air flow, the higher melt flow polymer will produce finer fibers at commercially acceptable throughputs. A commercially acceptable throughput is above 3 PIH. Lower throughputs, however, will further reduce the fiber and pore sizes of the meltblown layer 32.

The resulting meltblown web 32 with its fine fibers and resulting small pore size distribution has superior barrier properties when incorporated into a fabric laminate. Particularly, the unlaminated meltblown web 32 has an average fiber size of from 1 to 3 microns and pore sizes distributed predominantly in the range from 7 to 12 microns, with a lesser amount of pores from 12 to 25 microns, with virtually no pores greater than 25 microns, and with the peak of the pore size distribution less than 10 microns.

When the meltblown web 32 is incorporated into the SMS fabric laminate 12, the peak of the pore size distribution in the resulting SMS fabric laminate is shifted downward by about 5 microns when compared with the SMS fabric laminate made with conventional meltblown material. The SMS fabric laminate 12 has pore sizes distributed predominantly in the range from 5 to 10 microns, with a lesser amount of pores from 10 to 15 microns, with virtually no pores greater than 22 microns.

Figure 3:
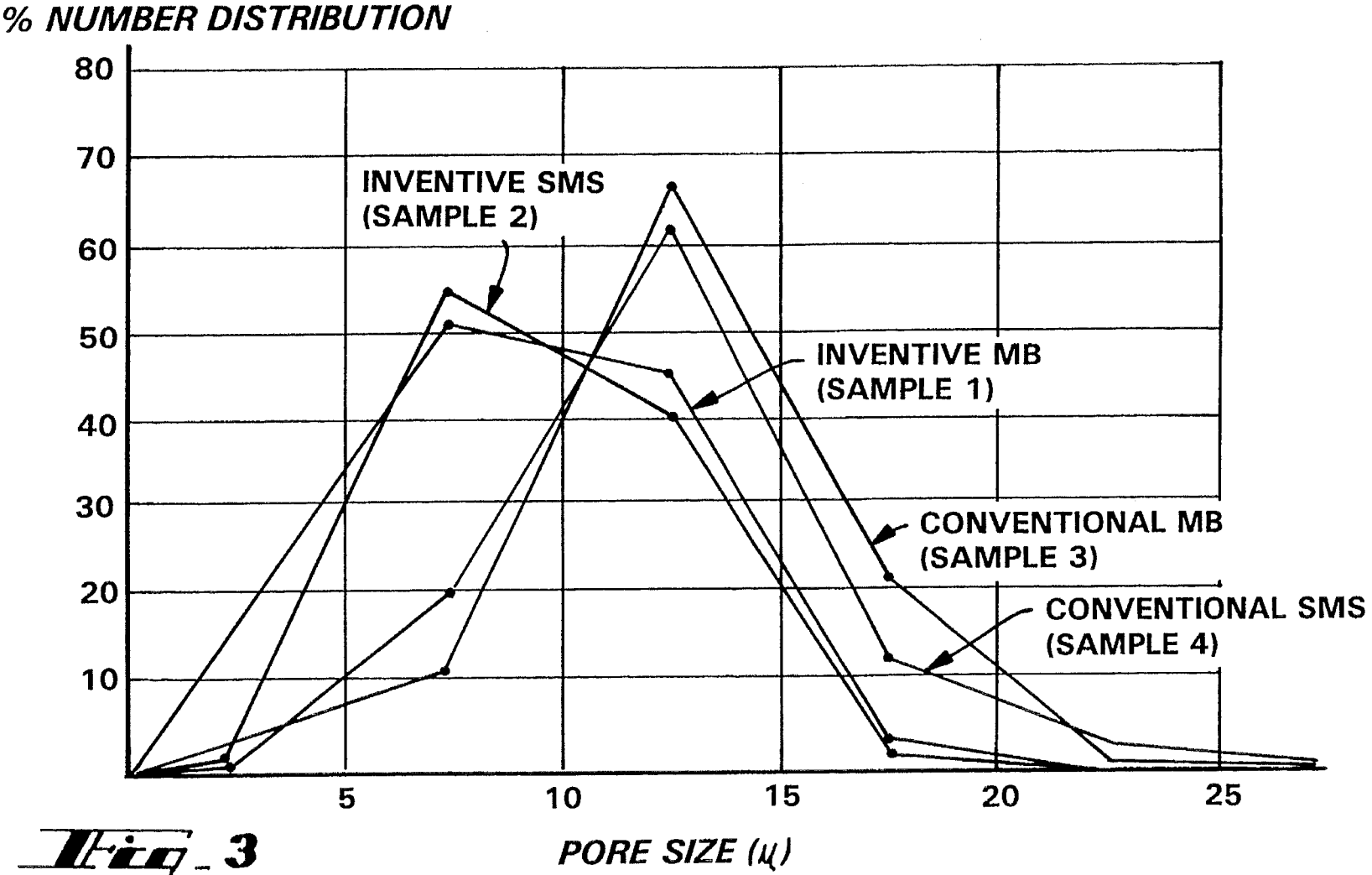
FIG. 3 is a graph showing the pore size distribution for a meltblown web made in accordance with the present invention (Sample 1), an SMS fabric laminate incorporating such a meltblown web as a barrier layer (Sample 2), a conventional meltblown web (Sample 3), and a conventional SMS fabric laminate (Sample 4).

FIG. 3 shows the pore size distribution for a meltblown web made in accordance with the present invention (Sample 1), an SMS fabric laminate made using the meltblown web of the present invention (Sample 2), a conventional meltblown web (Sample 3), and an SMS fabric laminate such as Kimberly-Clark's Evolution® SMS medical fabric laminate made using the conventional meltblown web (Sample 4). Particularly, the meltblown web of the present invention and the SMS fabric laminate of the present invention were made in accordance with Example 1 below.

The present invention can be carried out with polyolefins including predominantly propylene polymer but which may include, polyethylene, or other alphaolefins polymerized with Ziegler-Natta catalyst technology, and copolymers, terpolymers, or blends thereof. Polypropylene is preferred.

Two methods can be used to achieve the high melt flow polymer which is useful in producing a nonwoven web of fine fibers at commercial production speeds. The first and preferred method is to start with a reactor granule polypropylene resin having a molecular weight distribution between 3.6 and 4.0 Mw/Mn and a high melt flow rate of up to 3000 gms/10 min. at 230° C. A small amount of peroxide is added to the starting resin to modify the molecular weight distribution to a range of 2.8 to 3.5 Mw/Mn and to increase the melt flow rate of greater than 2000 gms/10 min at 230° C.

The second but less preferred method for producing nonwoven webs of fine fibers in accordance with the present invention is to use starting reactor granular polypropylene resin having a molecular weight distribution between 4.0 and 4.8 Mw/Mn and a melt flow rate ranging from 400 to 1000 gms/10 min. at 230° C. The polypropylene resin is modified by adding peroxide in amounts ranging from 500 to 3000 ppm to (the higher amounts of peroxide being used in connection with the lower initial melt flow rate). The modified polypropylene resin has a melt flow rate up to about 3000 gms/10 min. at 230° C. and a narrower molecular weight distribution of 2.2 to 2.8 Mw/Mn. This second method produces a narrower molecular weight distribution between 2.2 and 2.8 Mw/Mn than the preferred method and thus has a tendency to produce more lint and polymer droplets.

EXAMPLE 1

In order to illustrate the foregoing invention, a meltblown web was formed on a conventional meltblowing forming line using the modified polymer of the present invention. In addition, an SMS fabric laminate was formed using the inventive meltblown web as an internal barrier layer. The SMS fabric laminate had spunbonded layers formed in conventional fashion of polypropylene. The SMS fabric laminate was preferably formed on-line by a multi-station forming machine as illustrated in FIG. 1. The meltblown web and meltblown barrier layer for the SMS fabric laminate were formed from reactor granules of polypropylene having a starting molecular weight distribution between 4.0 and 4.5 Mw/Mn and a melt flow rate of about 2000 gms/10 min. at 230° C. The starting polypropylene resin was treated with about 500 ppm of peroxide to produce a resin having a melt flow rate greater than 3000 gms/10 min. at 230° C. and a molecular weight distribution of from 2.8 to 3.5 Mw/Mn. The broader molecular weight distribution at the high melt flow rate helps minimize production of lint and polymer droplets.

The meltblown web, prepared in accordance with the foregoing, had a basis weight of 0.50 oz./yd.$^2$ and was designated as Sample 1. The SMS fabric laminate, having a meltblown internal barrier layer made in accordance with the present invention, had spunbonded layers with a basis weight of 0.55 oz./yd. $^2$, and the meltblown barrier layer had a basis weight of 0.50 oz./yd.$^2$. The inventive SMS fabric laminate was designated as Sample 2.

In addition, a conventional meltblown web and a conventional SMS fabric laminate (Kimberly-Clark's Evolution® fabric laminate) having the same basis weights as the inventive web and inventive SMS fabric laminate were prepared as controls. The control meltblown web was designated Sample 3, and the control SMS fabric laminate was designated Sample 4. The Samples 1 through 4 possess the characteristics set forth in Tables 1 and 2 below:

TABLE 1

| | % Pore Size Distribution | | | |
|---|---|---|---|---|
| | 0–5μ | 5–10μ | 10–15μ | 15–20μ |
| Sample 1 | | 50.7 | 45.8 | 2.9 |
| Sample 2 | 1.8 | 55.4 | 40.3 | 1.9 |
| Sample 3 | | 10.5 | 67.7 | 21.4 |
| Sample 4 | 1.2 | 20.0 | 61.6 | 11.6 |
| | 20–25μ | 25–30μ | Maximum pore Size | |
| Sample 1 | 0.6 | 0 | | |
| Sample 2 | 0.4 | 0 | 22.0μ | |
| Sample 3 | 0.5 | 0.1 | | |
| Sample 4 | 1.2 | 0.9 | 38.2μ | |

The pore size distribution set out in Table 1 was measured by the Coulter Porometer. The pore size distribution set out in Table 1 is shown graphically in FIG. 3. The plots shown in FIG. 3 show the finer pore size distribution for Samples 1 and 2 as compared to Samples 3 and 4 respectively. The pore size distribution for the inventive web and inventive SMS fabric laminate is narrower than the conventional meltblown web and conventional SMS fabric laminate. It should be noted that the pore size distribution for the inventive SMS fabric laminate has its curve shifted downward in terms of pore size from the curve of the laminate made using conventional meltblown material. Additionally, the lamination process and the additional spunbonded layers apparently cause the pore structure to close up thereby increasing the barrier properties of the resulting fabric laminate. The distribution of the pore sizes predominantly between 5 to 10 microns represents a fabric laminate (Sample 2) that is finer in its construction than conventional fabric laminates (Sample 4) with the resulting improved barrier properties.

The improved barrier properties of the inventive fabric laminate (Sample 2) as compared to the conventional fabric laminate (Sample 4) are shown in Table 2 below.

TABLE 2

| Barrier Properties | | |
|---|---|---|
| | Blood Strikethrough | |
| | t = 0 min. p = 1 psi | t = 1 min. p = 1 psi |
| Sample 2 | 2.5% | 12.4% |
| Sample 4 | 10.6% | 14.5% |
| | Bacteria Filtration Efficiency | |
| Sample 2 | 95.4% | |
| Sample 4 | 91.9% | |

The blood strikethrough was measured by the following procedure. A 7 in. by 9 in. piece of each sample fabric was laid on top of a similar sized piece of blotter paper. The blotter paper was supported on a water filled bladder which was in turn supported on a jack. The jack was equipped with a gauge to determine the force exerted from which the pressure exerted by the bladder on the blotter paper was calculated. A 1.4 gm sample of bovine blood was placed on top of the fabric sample and covered with a piece of plastic film. A stationary plate was located above the plastic film. The water bladder was then jacked up until a pressure of 1 psi was attained on the bottom of the blotter paper. As soon as the pressure was achieved, that pressure was held for the desired time. Once the time had elapsed, the pressure was released, and the blotter paper was removed and weighed. Based on the difference in weight of the blotter paper before and after, the percentage strikethrough was determined.

The test results indicate that the SMS fabric laminate made in accordance with the present invention has superior strikethrough characteristics especially for short elapsed times. Short elapsed times represent the situations that are most often encountered in medical use where blood generally will not remain for long on the drape or gown before it can run off.

The filter properties were measured to determine the ability of the SMS fabric laminate to block the penetration of air borne bacteria. The samples were tested in accordance with Mil. Spec. 36954-C 4.4.1.1.1 and 4.4.1.2.

The 3.5% increase in efficiency within the plus 90% range represents a significant improvement in filtration and the ability to preclude the passage of air borne bacteria.

Further illustrating the invention, results of several larger scale trials are noted in this example. From these trials it was confirmed that unless a high melt flow resin has the required molecular weight distribution or polydispersity index, the desired fiber size, resultant pore size and barrier properties are not achieved.

A polypropylene resin with a melt flow rate of 850 gms/10 min. at 230° C., 500 ppm peroxide and Mw/Mn of 3.8 was meltblown, combined into an SMS laminate as was a control meltblown from a 400 melt flow resin, 500 ppm peroxide and 4.0 Mw/Mn. Fiber size analysis of the meltblown from the two resins indicated a reduction in average fiber size from 4.1 microns (control) to 3.3 microns for the 850 melt flow resin. Variability was also reduced from 2.4 standard deviation to 1.9.

The meltblown web portion of the laminate was made at 0.50 osy, 0.40 osy and 0.30 osy. The SMS fabric laminate having the meltblown internal barrier layer made in accordance with the present invention had spunbond layers of 0.45 and 0.50 osy as outlined in Table 3.

TABLE 3

| | % Pore Size Distribution | | | | |
|---|---|---|---|---|---|
| | 1–10u | 10–15u | 15–20u | 20–25u | >25u |
| Sample 3-1 — 1.4 osy SMS/0.5 osy MB—MB resin control (400 MF) | 15.7 | 58.1 | 21.2 | 3.5 | 1.5 |
| Sample 3-2 — 1.4 osy SMS/0.5 osy MB—MB resin 850 MF | 62.1 | 34.1 | 2.8 | 0.1 | 0.9 |
| Sample 3-3 — 1.4 osy SMS/0.4 osy MB—MB resin 850 MF | 31.4 | 62.5 | 3.4 | 2.7 | 0.0 |
| Sample 3-4 — 1.3 osy SMS/0.3 osy MB—MB resin 850 MF | 37.9 | 56.1 | 3.3 | 2.3 | 0.4 |

Even at the lighter meltblown basis weights of 0.4 and 0.3 osy, the pore size distribution is shifted downwards compared to the standard resin at 0.5 osy resulting in a tighter web with improved barrier properties expected. This may allow reduced basis weight meltblown webs to be used resulting in cost savings or combining with heavier spunbond layers for stronger laminates.

The improved barrier properties of the inventive fabric laminate (Samples 3-2, 3-3, 3-4) as compared to the conventional fabric (Sample 3-1) is shown in Table 4 below.

TABLE 4

| Basis Wtg. osy | | Barrier Results | | | | | | | |
|---|---|---|---|---|---|---|---|---|---|
| | | Bacterial Filtration Efficiency | | Dry Spore #/1000 | | Hydrohead cm $H_2O$ | | Blood Strike thru % | |
| SMS/MB | Resin | x | s | x | s | x | s | x | s |
| Sample 3-1 1.4/.5 | Control 400 MF | 79.3 | 2.67 | 1.1 | .065 | 29.9 | 8.6 | 3.40 | 1.62 |
| Sample 3-2 1.4/.5 | 850 MF | 89.8 | 2.19 | 0.49 | .021 | 32.1 | 8.8 | 4.03 | 1.85 |
| Sample 3-3 1.4/.4 | 850 MF | 91.0 | 1.31 | 0.88 | .075 | 50.9 | 8.9 | 1.77 | 1.58 |
| Sample 3-4 1.3/.3 | 850 MF | 87.8 | 1.98 | 0.48 | .044 | 54.0 | 15.3 | 1.25 | 2.23 |

A polypropylene resin was a melt flow of 1000 gms/10 min at 230° C., 500 ppm peroxide and a Mw/Mn of 5.2 was also meltblown and combined into an SMS laminate. The meltblown basis weight was 0.50 osy and each spunbond layer was 0.55 osy combined into a 1.6 osy SMS.

In-process testing of the laminate with the 1000 MF, 5.2 Mw/Mn resin indicated hydrohead values remained at 50 cm while spray impact values worsened from 1.5 gms to 6–7 gms. These in-process test values were compared to immediately prior results with a 400 gms/10 min at 230° C. 500 ppm peroxide and Mw/Mn 4.0 standard meltblown polypropylene resin.

TABLE 5

| SAMPLE | CONSTRUCTION S/M/M/S | BWT EXP (OSY) | BWT ACT (OSY) | HYDRO (CM) | PEEL (IN) | GRAB MD (LBS) | GRAB CD (LBS) | TRAP MD (LBS) | TRAP CD (LBS) | ABRASION (CYCLES) |
|---|---|---|---|---|---|---|---|---|---|---|
| 4-0 | 2.0SB/0.6MB/0.6MB/2.0SB | 5.2 | 5.2 | 66 | 1.8 | 69 | 71 | 18 | 19 | 43 |
| 4-1 | 2.0SB/0.6HMFMB/0.6HMFMB/2.0SB | 5.2 | 5.2 | 83 | 1.6 | 76 | 75 | 20 | 25 | 46 |
| 4-2 | 2.0SB/0.4HMFMB/0.4HMFMB/2.0SB | 4.8 | 4.8 | 76 | 1.4 | 73 | 71 | 20 | 20 | 48 |
| 4-3 | 2.0SB/0.3HMFMB/0.3HMFMB/2.0SB | 4.6 | 4.7 | 72 | 0.9 | 66 | 66 | 18 | 20 | 46 |
| 4-4 | 2.0SB/0.2HMFMB/0.2HMFMB/2.0SB | 4.4 | 4.4 | 59 | 3.1 | 67 | 65 | 21 | 18 | 49 |
| 4-5 | 2.0SB/0.4HMFMB/0.4HMFMB/1.5SB | 4.3 | 4.3 | 84 | 2.2 | 65 | 58 | 17 | 18 | 40/18 |
| 4-6 | 2.0SB/0.3HMFMB/0.3HMFMB/1.5SB | 4.1 | 4.1 | 71 | 1.4 | 65 | 57 | 17 | 18 | 41/20 |

SB = SPUNBOND
MB = MELTBLOWN
HMFMB = HIGH MELTFLOW MB

Example 4

This Example demonstrates application of the present invention as a heavy basis weight car cover material. Samples were prepared generally as described in Example 1 of coassigned U.S. Pat. No. 4,374,888 issued 22 Feb. 1983 to Bornslaeger, the disclosure of which is incorporated herein by reference, except that the fire retardant chemical was omitted, a different UV stabilizer, Chimassorb 944L (a polymeric hindered amine) was used, and the basis weights of the layers were as indicated.

These materials were tested for barrier, strength and abrasion properties with the results shown in Table 5. Grab tensile was determined by Method 5100—Federal Test Methods Standard No. 191A.

Trap tear was determined by ASTM Standard Test D1117-14.

Peel strength was determined by ASTM Standard Test D2724.13 except that the sample size used was 2 inches by 6 inches and the gauge length was set at 1.0 inch; the value of the peak load, alone, was defined as the bond strength of the specimen.

For the high melt flow meltblown fiber diameter determinations showed a mean diameter of 2.6 microns and 2.9 microns with standard deviations of 1.3 microns and 1.5 microns, respectively.

Thus, in accordance with the invention there has been described an improved nonwoven laminate web. Variations and alternative embodiments will be apparent to those skilled in the art and are intended to be embraced within the appended claims.

We claim:

1. A laminate comprising a fine fiber nonwoven fabric barrier layer which layer is formed from a reactor granule of a modified polymer which polymer has a molecular weight distribution between 2.2 and 3.5 Mw/Mn and a melt flow rate greater than 800 gms/10 min at 230° C. and wherein the pore size distribution of said laminate is shifted downward.

2. The laminate of claim 1, wherein the polymer is a polyolefin.

3. The laminate of claim 2, wherein the polymer is polypropylene.

4. The laminate of claim 1, wherein the fabric laminate has pore sizes distributed predominantly in the range from 5 to 10 microns with the peak of the pore size distribution less than 10 microns.

5. The laminate of claim 4, wherein the fabric laminate has pore sizes distributed predominantly in the range from 5 to 10 microns, with a lesser amount of pores from 10 to 15 microns, with virtually no pores greater than 22 microns, and with the peak of the pore size distribution less than 10 microns.

6. A laminate comprising a fine fiber nonwoven fabric barrier layer which layer is formed from a reactor granule of a modified polymer which polymer has a molecular weight distribution between 2.8 and 3.5 Mw/Mn and a melt flow rate greater than 3000 gms/10 min at 230° C. and wherein the pore size distribution of said laminate is shifted downward.

7. The laminate of claim 6, wherein the polymer is a polyolefin.

8. The laminate of claim 7, wherein the polymer is polypropylene.

9. The laminate of claim 6, wherein the fabric laminate has pore sizes distributed predominantly in the range from 5 to 10 microns with the peak of the pore size distribution less than 10 microns.

10. The laminate of claim 9, wherein the fabric laminate has pore sizes distributed predominantly in the range from 5 to 10 microns, with a lesser amount of pores from 10 to 15 microns, with virtually no pores greater than 22 microns, and with the peak of the pore size distribution less than 10 microns.

11. The laminate of claim 1 wherein said modified polymer has a molecular weight distribution between 2.2 and 2.8 Mw/Mn.

12. The laminate of claim 11, wherein the polymer is a polyolefin.

13. The laminate of claim 12, wherein the polymer is polypropylene.

14. A nonwoven SMS fabric laminate having an internal fine fiber nonwoven barrier layer which layer is formed from a reactor granule of a modified polymer which polymer has a molecular weight distribution between 2.2 and 3.5 Mw/Mn and a melt flow rate greater than 800 gms/10 min at 230° C. and wherein the pore size distribution of said laminate is shifted downward.

15. The nonwoven SMS fabric laminate of claim 14, wherein the polymer is a polyolefin.

16. The nonwoven SMS fabric laminate of claim 15, wherein the polymer is polypropylene.

17. The nonwoven SMS fabric laminate of claim 14 wherein said modified polymer has a molecular weight distribution between 2.8 and 3.5 Mw/Mn and a melt flow rate greater than 3000 gms/10 min at 230° C.

18. The nonwoven SMS fabric laminate of claim 17, wherein the polymer is a polyolefin.

19. The nonwoven SMS fabric laminate of claim 18, wherein the polymer is polypropylene.

20. The nonwoven SMS fabric laminate of claim 14 wherein said modified polymer has a molecular weight distribution between 2.2 and 2.8 Mw/Mn.

21. A sterilization wrap comprising the laminate of claim 1.

22. A recreational fabric comprising the laminate of claim 1.

23. A sterilization wrap comprising the laminate of claim 14.

24. A recreational fabric comprising the laminate of claim 14.

25. A surgical fabric comprising the laminate of claim 1.

26. A surgical fabric comprising the laminate of claim 14.

* * * * *